US008534480B1

(12) United States Patent
Hanna

(10) Patent No.: US 8,534,480 B1
(45) Date of Patent: Sep. 17, 2013

(54) TANK SEGMENT CONNECTION APPARATUS

(75) Inventor: Matthew Hanna, Brashear, TX (US)

(73) Assignee: Pinnacle Companies, Inc., Sulphur Springs, TX (US)

( * ) Notice: Subject to any disclaimer, the term of this patent is extended or adjusted under 35 U.S.C. 154(b) by 0 days.

(21) Appl. No.: 13/495,842

(22) Filed: Jun. 13, 2012

(51) Int. Cl.
*B65D 6/00* (2006.01)

(52) U.S. Cl.
USPC ..... 220/4.17; 220/693; 220/4.16

(58) Field of Classification Search
USPC ..... 220/4.12, 4.16, 4.17, 4.09, 693, 692
See application file for complete search history.

(56) References Cited

U.S. PATENT DOCUMENTS

| | | | | |
|---|---|---|---|---|
| 235,311 | A | 12/1880 | Stephenson | |
| 289,726 | A | 12/1883 | Tevis | |
| 869,210 | A | 10/1907 | Martin et al. | |
| 1,651,317 | A * | 11/1927 | Bell | 220/4.09 |
| 1,713,730 | A | 5/1929 | Wright | |
| 1,915,757 | A | 6/1933 | Pierce | |
| 2,243,723 | A | 5/1941 | Tench | |
| 2,329,678 | A | 9/1943 | Pennington | |
| 2,371,902 | A | 3/1945 | Long | |
| 2,384,939 | A | 9/1945 | Lord | |
| 2,527,653 | A | 10/1950 | Pierce | |
| 2,567,164 | A | 9/1951 | Brehany et al. | |
| 2,726,123 | A | 12/1955 | Matthews | |
| 2,727,286 | A * | 12/1955 | Moore | 403/40 |
| 2,904,126 | A | 9/1959 | Meng et al. | |
| 3,084,638 | A | 4/1963 | Allegrette | |
| 3,225,362 | A * | 12/1965 | Barrera | 52/169.1 |
| 3,262,517 | A | 7/1966 | Malec | |
| 3,489,320 | A | 1/1970 | MacKinnon | |
| 3,490,558 | A | 1/1970 | Foley | |
| 3,510,142 | A | 5/1970 | Erke | |
| 3,726,431 | A | 4/1973 | Botkin | |
| 3,793,178 | A | 2/1974 | Austin et al. | |
| 3,884,373 | A | 5/1975 | Archibald | |

(Continued)

FOREIGN PATENT DOCUMENTS

| | | |
|---|---|---|
| DE | 3320969 A1 | 12/1984 |
| EP | 0937606 A2 | 8/1999 |

(Continued)

OTHER PUBLICATIONS

Connecting Catwalk Corrugated Wall Liquid Storage Brochure, Dragon Products LTD.

(Continued)

*Primary Examiner* — Stephen Castellano
(74) *Attorney, Agent, or Firm* — Carstens & Cahoon, LLP; Vincent J. Allen

(57) ABSTRACT

There are provided tank walls constructed from a plurality of tank wall sections joined together, connectors connecting the tank wall sections, and methods of constructing the tank walls. An exemplary embodiment provides a tank wall section having a first end that includes a series of spaced apart through holes. The tank wall section also has a second end that includes a series of spaced apart nubs. The nubs are sized, configured and spaced apart to register with the series of spaced apart through holes of a second tank wall section. The through holes are each sized and shaped to receive a retaining pin extending through the first side of the nub and through the opposite side of the nub to thereby couple the tank wall section to a second tank wall section.

16 Claims, 5 Drawing Sheets

(56) References Cited

U.S. PATENT DOCUMENTS

| | | | | |
|---|---|---|---|---|
| 3,997,024 | A | | 12/1976 | Fredricks et al. |
| 4,018,354 | A | | 4/1977 | Lawler |
| 4,068,777 | A | | 1/1978 | Humphrey et al. |
| 4,106,423 | A | | 8/1978 | Glasfeld et al. |
| 4,108,326 | A | | 8/1978 | Bertolini |
| D253,051 | S | | 10/1979 | Pletcher |
| 4,171,550 | A | | 10/1979 | Phaup |
| 4,230,048 | A | | 10/1980 | Gordon et al. |
| 4,244,523 | A | | 1/1981 | Looper |
| 4,258,953 | A | | 3/1981 | Johnson |
| 4,318,549 | A | | 3/1982 | Pletcher |
| 4,351,478 | A | | 9/1982 | Looper |
| 4,406,471 | A | | 9/1983 | Holloway |
| 4,422,485 | A | | 12/1983 | O'Shea et al. |
| 4,572,328 | A | | 2/1986 | Benko |
| 4,589,565 | A | | 5/1986 | Spivey |
| 4,613,053 | A | | 9/1986 | Kimura et al. |
| 4,718,353 | A | | 1/1988 | Schuller et al. |
| 4,787,111 | A | | 11/1988 | Pacek et al. |
| D301,326 | S | | 5/1989 | Adams |
| 4,874,184 | A | | 10/1989 | Boyer |
| 5,004,269 | A | | 4/1991 | Pelt |
| D318,033 | S | | 7/1991 | Pelt |
| 5,033,637 | A | | 7/1991 | Webb |
| 5,054,635 | A | * | 10/1991 | Kolom ..... 220/4.15 |
| 5,058,924 | A | | 10/1991 | Whatley, Jr. |
| 5,122,025 | A | | 6/1992 | Glomski |
| 5,213,367 | A | | 5/1993 | Norman, Jr. et al. |
| 5,220,933 | A | | 6/1993 | Albers |
| 5,273,180 | A | | 12/1993 | Whatley, Jr. |
| 5,294,016 | A | | 3/1994 | Crenshaw |
| 5,301,980 | A | | 4/1994 | Dingle |
| D348,304 | S | | 6/1994 | Norman, Jr. et al. |
| 5,346,093 | A | | 9/1994 | De Benedittis et al. |
| D353,352 | S | | 12/1994 | Holloway, Jr. |
| 5,538,286 | A | | 7/1996 | Hoff |
| D375,470 | S | | 11/1996 | Adams |
| 5,607,133 | A | | 3/1997 | Markham et al. |
| D378,810 | S | | 4/1997 | Norman, Jr. et al. |
| D379,948 | S | | 6/1997 | Wade |
| 5,653,469 | A | | 8/1997 | Wade |
| 5,671,855 | A | | 9/1997 | Norman, Jr. et al. |
| D384,913 | S | | 10/1997 | Norman, Jr. et al. |
| 5,676,460 | A | | 10/1997 | Biberstine et al. |
| 5,678,978 | A | | 10/1997 | Markham |
| 5,718,382 | A | | 2/1998 | Jaeger |
| 5,743,191 | A | | 4/1998 | Coslovi |
| 5,816,423 | A | | 10/1998 | Fenton et al. |
| 5,957,500 | A | | 9/1999 | Wade |
| D417,171 | S | | 11/1999 | Satterfield et al. |
| 5,979,335 | A | | 11/1999 | Saxton et al. |
| 6,045,157 | A | | 4/2000 | Poulin |
| 6,098,744 | A | | 8/2000 | Kawamura |
| 6,152,492 | A | | 11/2000 | Markham et al. |
| 6,173,991 | B1 | | 1/2001 | Piona et al. |
| 6,176,279 | B1 | | 1/2001 | Dahlin et al. |
| 6,199,910 | B1 | | 3/2001 | Wade |
| D441,692 | S | | 5/2001 | Niblett et al. |
| 6,279,955 | B1 | | 8/2001 | Fisher |
| 6,354,787 | B1 | | 3/2002 | O'Daniel |
| 6,375,222 | B1 | | 4/2002 | Wade |
| 6,390,325 | B1 | | 5/2002 | Gonzales |
| 6,431,093 | B1 | | 8/2002 | Hansen |
| 6,645,016 | B1 | | 11/2003 | Andersen et al. |
| 6,659,225 | B2 | | 12/2003 | Olliges et al. |
| 6,761,414 | B1 | | 7/2004 | Broberg |
| 6,793,178 | B2 | | 9/2004 | Peterson |
| 6,799,975 | B1 | | 10/2004 | Dunn |
| 6,957,806 | B2 | | 10/2005 | Tubbs |
| 7,080,806 | B2 | | 7/2006 | Mills |
| 7,228,936 | B2 | | 6/2007 | Wyse et al. |
| 7,244,123 | B1 | | 7/2007 | Barron |
| 7,300,073 | B2 | | 11/2007 | Bachman |
| D557,178 | S | | 12/2007 | Petzitillo, Jr. et al. |
| 7,387,316 | B2 | | 6/2008 | Keiser |
| 7,413,377 | B2 | | 8/2008 | Pontano, III |
| 7,448,586 | B2 | | 11/2008 | Ziaylek et al. |
| 7,472,663 | B1 | | 1/2009 | Horn |
| 7,503,535 | B2 | | 3/2009 | Ziaylek |
| 7,624,843 | B2 | | 12/2009 | Cresswell |
| 7,762,588 | B2 | | 7/2010 | Markham |
| 7,815,222 | B2 | | 10/2010 | Markham |
| 7,900,936 | B2 | * | 3/2011 | Imai ..... 277/598 |
| 7,997,441 | B2 | | 8/2011 | Marcel |
| 8,365,937 | B2 | * | 2/2013 | Lovelace et al. ..... 220/4.17 |
| 8,376,167 | B2 | * | 2/2013 | Lovelace et al. ..... 220/4.17 |
| 2003/0020253 | A1 | | 1/2003 | Bosman et al. |
| 2005/0115621 | A1 | | 6/2005 | Van Vliet et al. |
| 2008/0251322 | A1 | | 10/2008 | Irvin |
| 2009/0090581 | A1 | | 4/2009 | Kennedy |
| 2010/0013206 | A1 | | 1/2010 | Markham |
| 2010/0032435 | A1 | | 2/2010 | Satterfield et al. |
| 2011/0265685 | A1 | | 11/2011 | Swygert |

FOREIGN PATENT DOCUMENTS

| | | | |
|---|---|---|---|
| FR | 2595999 | A1 | 9/1987 |
| FR | 2655172 | A1 | 5/1991 |
| FR | 2670453 | A1 | 6/1992 |
| JP | 9240359 | A | 9/1997 |

OTHER PUBLICATIONS 10,000 to 21,000 Gal Frac Tanks Brochure, Dragon Products LTD.

* cited by examiner

TANK SEGMENT CONNECTION APPARATUS

BACKGROUND

1. Technical Field

The technology relates to the field of fluid storage tanks, and more particularly to the fabrication of large above-ground storage tanks that can be used to contain brine, for example, in connection with oil and gas production.

2. Description of the Related Art

There has been an increasing demand for energy worldwide. As a result, many different technologies are being used to meet this demand, and many are under development. Current technologies include, for example, traditional oil and gas production, secondary and enhanced oil and gas recovery techniques, coal production, use of solar panels and wind turbines to generate electricity, production of bio-fuels, use of ocean waves to generate electricity, and the use of nuclear reactors to generate electricity. It is known that in several parts of the world there are large subterranean reservoirs of natural gas, a desirable clean burning fuel, held in relatively impermeable geological formations. The relative impermeability of these formations presents a challenge to the production of these gas reserves because the gas is "tightly held" within the formations and cannot readily flow to a production well.

The technique of hydraulic fracturing of impermeable subterranean formations is being used to produce gas from relatively impermeable formations. Hydraulic fracturing, also known as "fracking" or "hydro-fracking," is a technology that fractures underground formations creating flow pathways for release of the trapped natural gas and production of that gas for commercial purposes.

During gas production, "brine" containing injected chemicals is produced. This brine must be disposed of in an environmentally acceptable manner. In addition, the fracking operation typically consumes large amounts of water for hydraulic fracturing of the formations. So, before fracking there is a need for short term storage of the hydro-fracking fluid, and after fracking there is a need to store the brine produced.

Brine may be stored above ground in storage tanks for a period of time. There are several different tank designs. However, they should preferably meet criteria of durability and resistance to leaks under the conditions of use, and should be relatively easy and inexpensive to transport and construct. In the case of some above-ground tank designs that require conjoining a series of wall sections, there are significant challenges on site in handling the heavy metal wall sections. Each wall section is hoisted by a crane and guided into place next to other already installed wall sections. In order to join wall sections together, depending upon the nature of the mechanical joining, it is often necessary to get alignment between the wall sections and overlap of the wall edges. Once aligned, the sections are joined together with mechanical connectors. To facilitate joining heavy wall sections together, workers have to manipulate the wall sections into appropriate position relative to each other. The use of manpower in proximity to heavy wall sections, while man-handling the wall sections, poses an issue of potential risk to the worker. In addition, the use of additional manpower to guide the wall sections incurs labor costs.

SUMMARY OF PREFERRED EMBODIMENT

The following is a summary of some aspects and exemplary embodiments of the present technology, of which a more detailed explanation is provided under the Detailed Description section, here below.

An exemplary embodiment provides a tank wall section having a tank wall body. The tank wall body has a first end that includes a series of spaced apart through holes. The tank wall body also has a second end that includes a series of spaced apart nubs. The nubs are sized, configured and spaced apart to register with the series of spaced apart through holes of a second tank wall section. The two tank wall sections are urged into alignment such that at their respective ends the nubs of one wall section fit into and extend through the through holes of the other wall section. The nubs each have affixing through holes extending from a first side of the nub through to an opposite side of the nub. The affixing through holes are each sized and shaped to receive a retaining pin extending through the first side of the nub and through the opposite side of the nub to thereby couple the tank wall section to a second tank wall section.

Another exemplary embodiment provides a method of connecting a plurality of tank wall sections together to construct a tank wall. The method includes the steps of selecting a first tank wall section having a first end and a second end; aligning the first end of the first tank wall section with a second end of a second tank wall section. In addition, it includes urging the first end of the first tank wall section toward the second end of the second wall section, then aligning the wall sections relative to each other. In the alignment step, mechanical structure proximate the end of one tank wall section engages with cooperating mechanical structure of the other tank wall end. The following steps include fastening the first end of the first tank wall section to the second end of the second wall section.

Another exemplary embodiment provides a tank constructed from a series of tank wall sections joined end to end. The tank wall includes a plurality of tank wall sections. Each tank wall section comprising a tank wall section body. Adjacent tank wall sections are joined together at their respective ends by connectors formed at least in part by cooperating mechanical structure at the ends of the tank walls. Each tank wall section has a tank wall body that has a first end that has a series of spaced apart through holes; and a second end including a series of spaced apart nubs. The nubs of a first tank wall section are configured and spaced apart to register with the series of spaced apart through holes of a second tank wall section. Each of the nubs have an affixing through hole extending from a first side through an opposite side, and a retaining pin is inserted into the affixing through hole. Thus, the tank wall is formed by aligning each of the wall sections with an adjacent wall section, bringing the ends of the wall sections into flush fitting relationship with each other, and inserting the retaining pins into the affixing through holes.

BRIEF DESCRIPTION OF THE DRAWINGS

Various embodiments will be described in conjunction with the following drawings which are schematic, not to scale, and wherein like numerals denote like elements, and.

DETAILED DESCRIPTION

The following provides a detailed description of exemplary embodiments of the tank wall section connectors, methods of using these connectors to make tank walls, and the tank walls constructed with the tank wall connectors. It should be understood that describing examples of these embodiments facilitates an understanding of the inventions, but the exemplary embodiments do not limit the scope of the inventions in any way. The inventions are demarcated only by the claims appended here below.

As a preliminary matter, liquids, such as brine and other fracking fluids, may be stored above ground in large storage tanks for a period of time. These wall sections are fabricated off-site in a machine-shop environment, and are very heavy because the tank wall has to be strong to be able to withstand significant force vectors generated by the mass of liquid in the tank. The wall sections are hoisted with cranes and stacked onto vehicles, like flat bed trucks, to be hauled to the site where the tank is to be constructed. As pointed out above, on site there are significant challenges in handling the heavy metal wall sections and in constructing the tank wall. Each wall section is hoisted by a crane and guided into place next to other already installed wall sections. In order to join wall sections together it is necessary to get alignment between the wall sections and overlap of the wall edges. To facilitate joining the heavy wall sections together, workers have had to manipulate the wall sections into appropriate position relative to each other. The use of manpower in proximity to heavy wall sections, while man-handling the wall sections, poses an issue of potential risk to the worker. In addition, the use of additional manpower to guide the wall sections incurs labor costs.

Exemplary embodiments provide tank walls constructed from a plurality of tank wall sections that are stackable for ease of transporting a plurality of sections one atop the other on a flat bed. Moreover, the exemplary tank wall sections have ends that are configured for ease of alignment with adjacent tank wall sections, through mechanical structure at the first ends that facilitate alignment through registration with cooperative mechanical structure at the second end. Further, the exemplary tank wall sections are conjoined to adjacent tank wall sections with connectors that are rugged, inexpensive to mass produce and very effective and easy to use in the field on-site.

Figure 1:
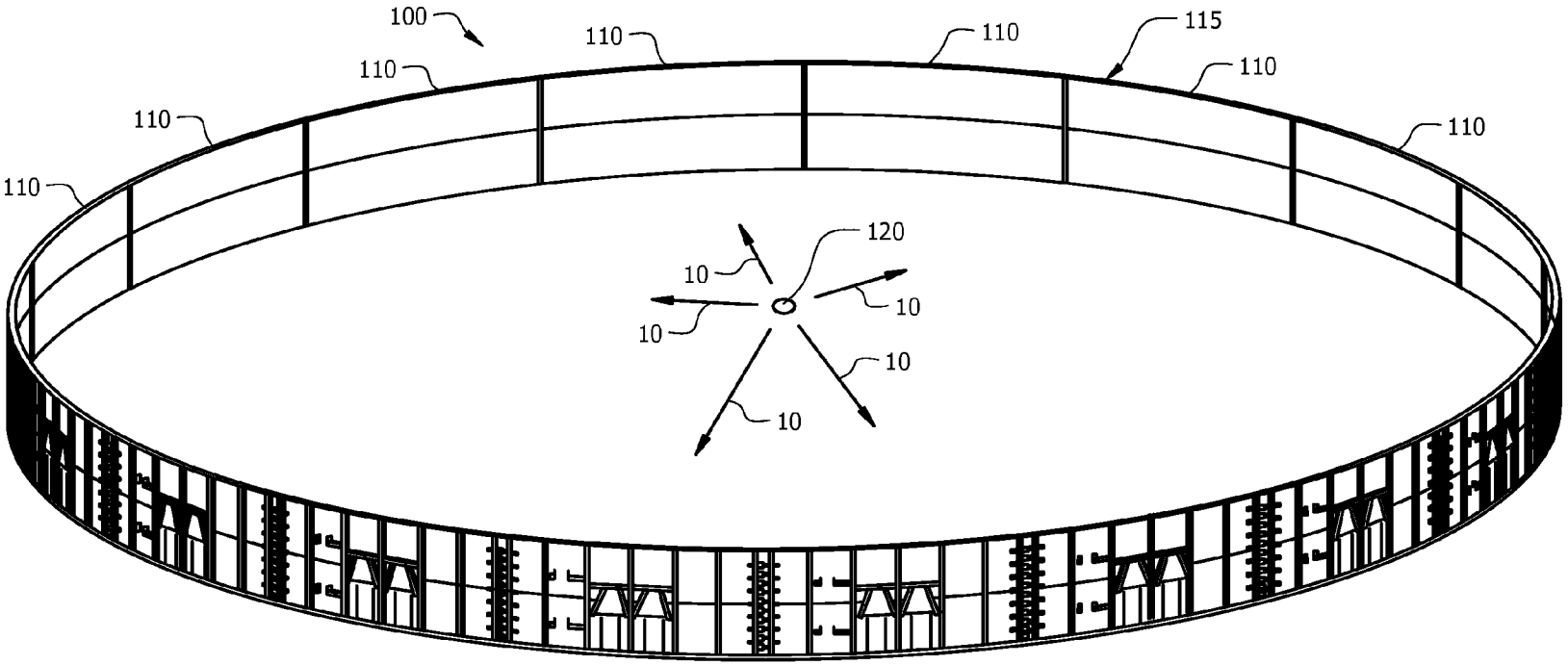
FIG. 1 is a perspective view of an exemplary embodiment of a tank constructed of a plurality of tank wall sections.
Figure 2:
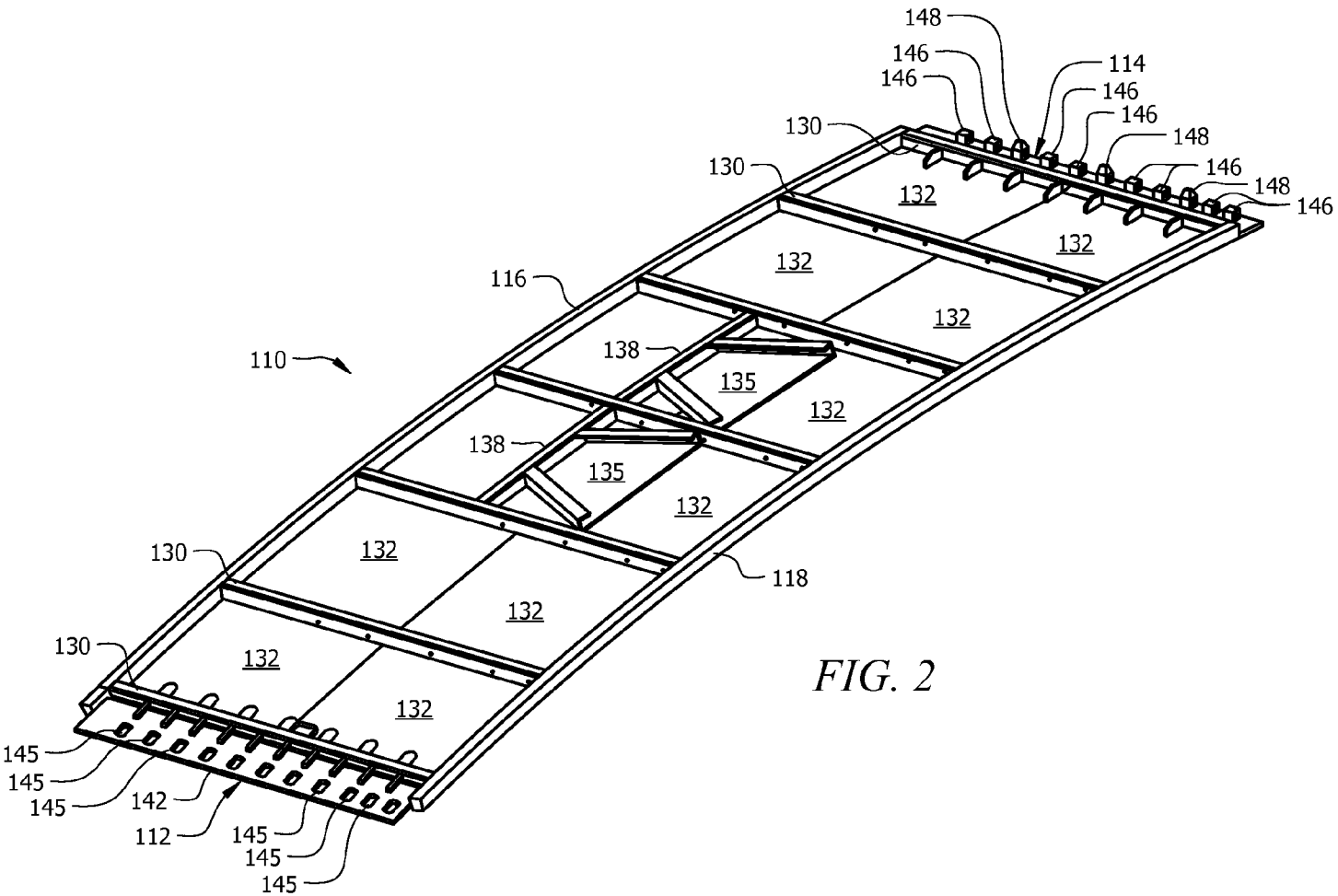
FIG. 2 is a perspective view of an exemplary embodiment of a tank wall section.
Figure 3:
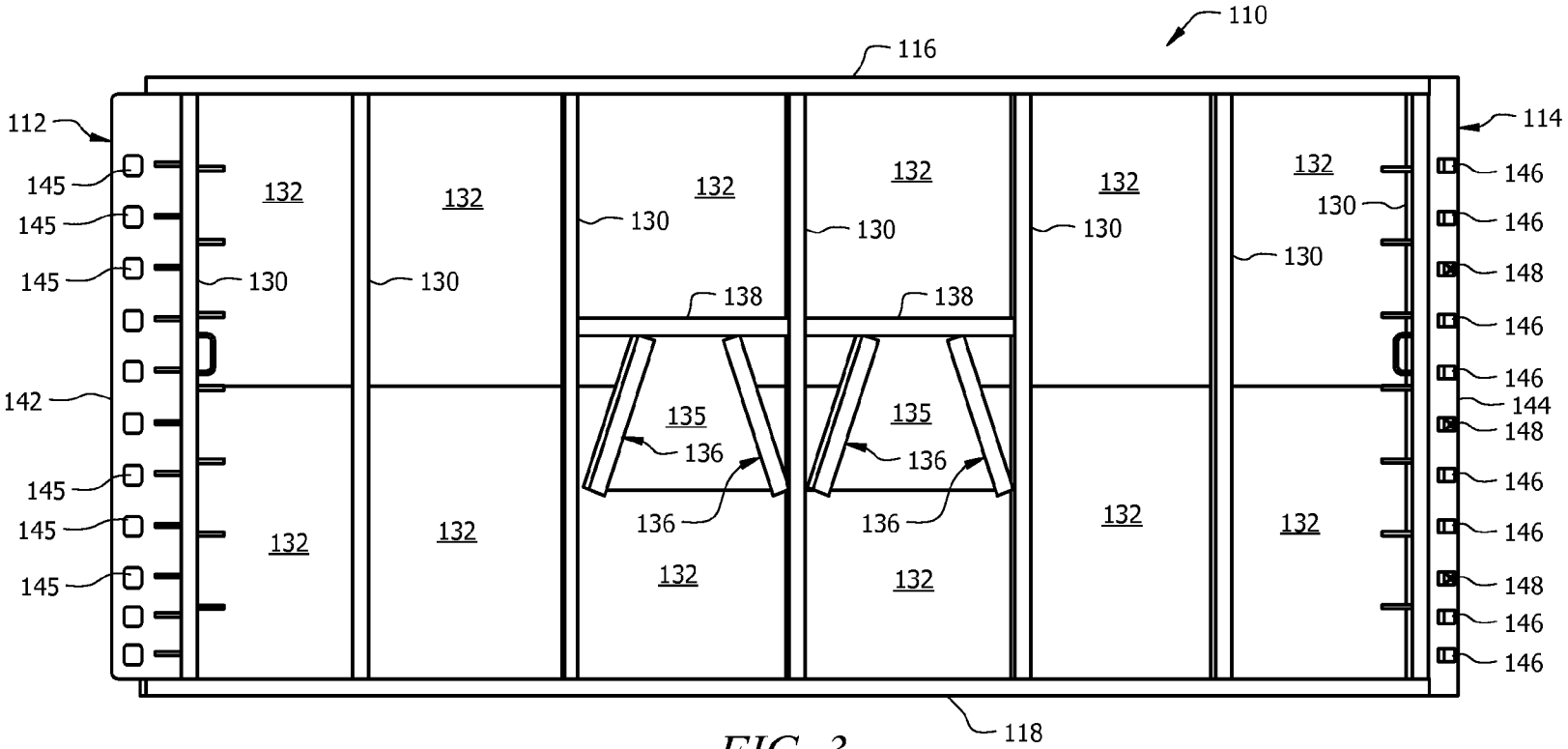
FIG. 3 is a side view of an exemplary embodiment of a tank wall section.

Referring to FIGS. 1, 2 and 3, the exemplary embodiment of a tank wall 100 of FIG. 1 is constructed from a plurality of tank wall sections 110, which are also depicted in FIGS. 2 and 3. In this example, the tank is cylindrical, although other shapes are also useful. Since the tank of the example is cylindrical or circular, the curved tank wall sections 110 are each in the shape of an arc subtended by radii extending from the center 120 of the tank 100 to the wall end portions 112 and 114 of the tank walls 110. When tank 100 is full of liquid, the mass of liquid within the tank 10 exerts a great deal of force against the tank wall 115, as indicated by force vectors 10 (arrows in FIG. 1). Accordingly, the tank wall 115 must withstand significant pressure without failing. It will be appreciated that even if the metal tank wall sections are individually strong, the potential weak points are at the connectors between wall sections 110. Therefore, these connectors must be strong and capable of withstanding pressure of the fluid contained in the tank 100. The joined areas need not necessarily be "leak proof" because the tank 100 is usually lined with a relatively thick plastic inner liner (not shown) that is selected to withstand conditions of use and to remain leak proof.

Referring to FIGS. 2 and 3, each illustrated example of a tank wall section 110 is substantially rectangular in shape but has a convex curvature corresponding to an arc of curvature of the tank wall 115. The exemplary rectangular and curved tank wall sections 110 are framed by opposed ends 112 and 114, and opposed upper curved beam 116 and lower curved beam 118. A series of support struts extend from the upper beam 116 to the lower beam 118 to provide structural reinforcement. The gaps between the struts 130 are covered with metal plate 132 to provide a continuous closed surface area extending between the outermost of struts 130 across the entire width of the tank wall section. (In this context, "outermost" means the struts furthest from the vertical center-line of the tank wall section, and "innermost" means struts closest to the center-line of the tank wall section.)

As pointed out above, the tank wall sections 110 are heavy. To facilitate lifting, transporting and manipulating the tank wall sections, they may be equipped with support receptacles 135, as in the illustrated embodiments. These examples of support receptacles 135 are trapezoidal in shape, but other shapes are also possible. The support receptacles 135 are each secured to the tank wall section with the upper end abutting a cross beam 138 that extends between the three innermost support struts 130. The support receptacles have slots 136 formed in their sides so that lifting plates (not shown), carried at the front end of a lifting crane, of corresponding shape to the support receptacles can slide into the slots 136. This facilitates lifting, transporting, manipulating and aligning the tank wall sections. Further, upon completion of these functions, the tank wall sections may be set down by sliding the lifting plates out of the support receptacles 135.

In the illustrated exemplary embodiments, the tank wall end portions 112, 114 include structure that facilitates conjoining the tank wall sections 110 together to construct a tank wall 115. One tank wall end portion 112 includes a vertically extending bracket 142 (which may be part of outermost wall plate 130) extending out beyond the outermost of struts 130. (In this context, vertical and horizontal refer to the orientation when the tank wall section is in the constructed tank wall.) Bracket 142 includes a series of vertically spaced apart through holes 145. As will become clear later, the size and shape of the through holes 145 should be configured to receive protruding structure, such as nubs of a different tank wall section.

The opposite end portion 114 of tank wall 110 includes a vertically-extending bracket 144 (which may be part of outermost wall plate 130) extending out beyond the outermost of struts 130. The bracket 144 is supplied with a vertical array of nubs 146, spaced, sized and shaped to register with and fit within through holes 145' of another tank wall section. In addition, the bracket 144, in the illustrated exemplary embodiment, includes three spaced apart elongated nubs 148. These elongated nubs 148 are also spaced, sized and shaped to register with and fit within through holes 145' of another tank wall section. The elongated nubs, as described here below, also serve to guide those tank wall sections to be conjoined into appropriate alignment for the wall section interconnections to be made.

While the exemplary embodiments depict nubs that appear to be square, other shapes of mechanical structures may also be used, as long as these extend outward ("protrude") from the tank wall end portion and mechanically engage cooperating mechanical structure on the end of another tank wall section, such that the mechanical structure and the cooperating mechanical structure can be locked together to form a connector. Examples of other shapes include pyramidal shapes, frusto-conical shapes, conical shapes, cylindrical shapes, star-shapes, and the like. Forming the connector may require a locking device, such as a retaining pin, a bolt, a threaded or unthreaded rod, a metal ring, or ring portion, and the like. Generally, the mechanical structure at one tank wall end may be referred to as a "male" connector part, and the cooperating mechanical structure at the end of the other tank wall section may be referred to as a "female" connector part. The male and female connector parts are sized and configured to engage mechanically, for example like the nubs fitting into the through holes, and a locking device, for example like a locking pin, locks the male and female connector parts together to form the connector. A plurality of such connectors arrayed vertically along the ends of the tank wall sections join adjacent tank wall sections together.

Figure 4A:
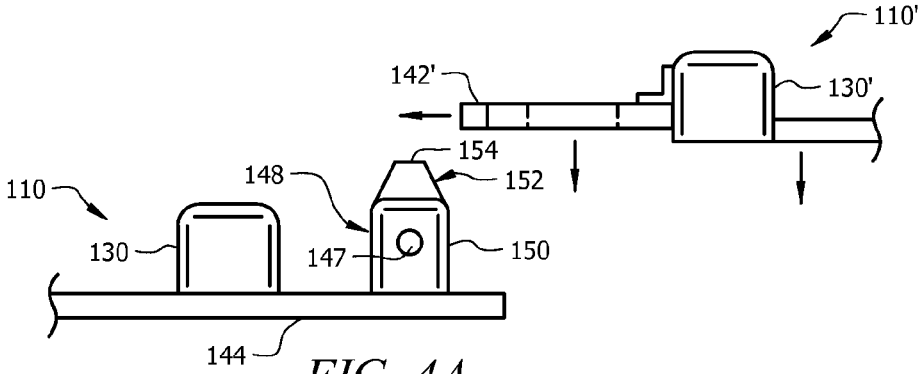
FIGS. 4A, 4B, 4C, and 4D are a series of side views illustrating the stages of bringing examples of tank wall ends into alignment until the tank wall ends are joined by the exemplary embodiments of the tank wall connectors.
Figure 4B:
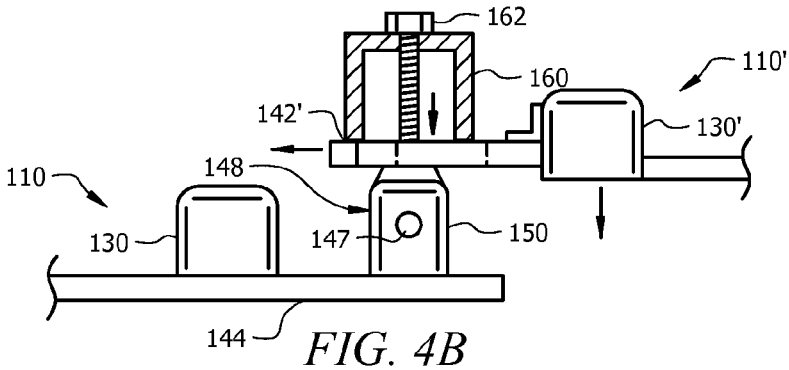
Figure 4C:
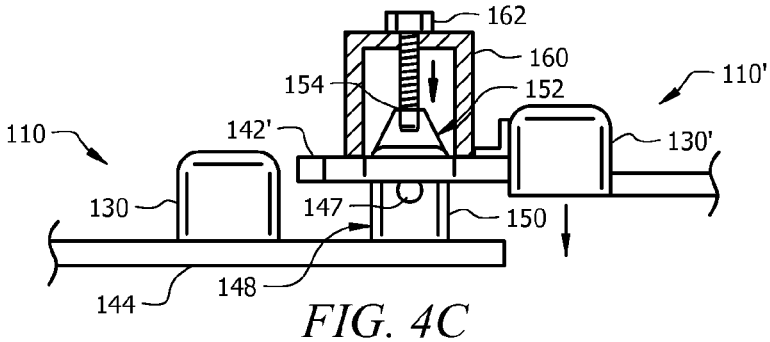
Figure 4D:
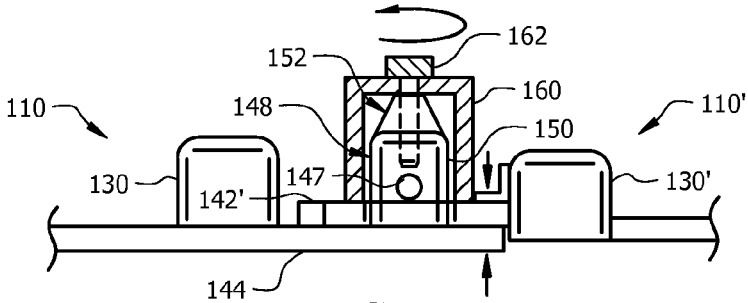
Figure 5:
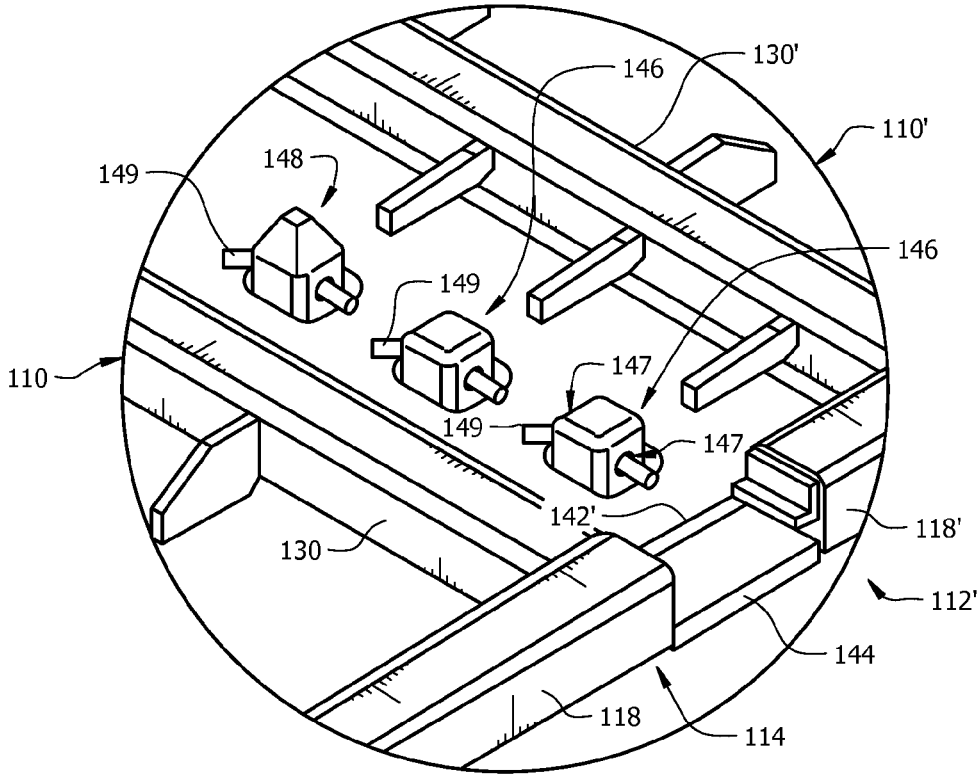
FIG. 5 is a partial perspective view of ends of adjacent conjoined tank wall sections showing an exemplary embodiment of tank wall connectors mechanically coupled together.

FIGS. 4A, 4B, 4C, 4D and 5, illustrate how exemplary tank wall sections are aligned and conjoined, and an example of the connection as completed. FIG. 5 shows end bracket 144 of a first tank wall section 110 joined to an end bracket 142' of a second tank wall section 110'. Each example of a nub 146 of bracket 144 is a cubic shape having four sides and a top, with a bottom welded, or otherwise attached, to the tank wall end bracket 144. Of course, it is readily apparent that any other shape may be used, as long as the shape and spacing corresponds to the shape and spacing of through holes 145' of end bracket 142' to facilitate registration and insertion into the through holes. The nubs 146 have affixing through holes extending through opposite sides that receive a retaining pin 149. It is clear from the illustration, that when retaining pin 149 is in place, the end portions 114 and 112' of the two tank wall sections cannot be separated; they are effectively mechanically fastened together by the exemplary three-part "nub-affixing through hole-and-retaining pin" connectors.

FIGS. 4A, 4B, 4C, and 4D are of an exemplary embodiment that illustrates "snapshots" of stages in bringing the ends of two heavy wall tank sections into closer alignment and fastening the two sections together with the "nub-affixing through hole-and-retaining pin" connectors. The arrows indicate directions of motion, urging and force vectors, as appropriate. In FIG. 4A, an end bracket 144 of tank wall section 110 is brought into proximity with an end bracket 142' of tank wall section 110'. The elongated nub 148 has a tapered nose portion 152 that tapers to a narrower cross section as the nose portion 152 extends farther away from the bracket 144. Thus, the end of nose portion 152 is an easier "target" to insert into the corresponding through hole 145' of the end bracket 142', and also permits use of a tank wall clamp, explained below, to pull the two tank wall section end brackets into flush alignment for joining them together. When the top 154 of nose portion 152 enters the through hole 145', the taper of its sides facilitates guided sliding of the elongated nub body 152 into the through hole 145' as the two wall section ends are urged toward each other. This is illustrated in FIGS. 4B and 4C. While the illustrated nose portion is pyramidal (with a flat top) it can also be frusto-conical or any other shape that extends beyond the extent of outward protrusion of the nubs 146.

It should be clear that as the elongated nubs 148 enter the corresponding through holes 145' and align the two wall sections, the other nubs 146 also enter their corresponding through holes 145'. To ensure this, the end bracket 144 may be supplied with two or more elongated nubs. The illustrated example of FIG. 3 depicts a top, middle and lower elongated nub to ensure guided nub and through-hole engagement all along the vertical height of the wall sections. More or fewer elongated nubs may be used as necessary and appropriate.

Notwithstanding the guided engagement illustrated stagewise in FIGS. 4A, 4B, and 4C, the affixing through holes 147 of the nubs must appear outside the surface of the end bracket 142' so that a retaining pin may be used to effectively connect the two wall sections 110, 110' when their respective end brackets 144, 142' are flush against each other. Each affixing through hole 147 has a lower end that is a distance from the end bracket 144 that approximates to, or is slightly larger than, the thickness of end bracket 142'. This selection of distance ensures flush fitting of the end brackets to each other when the retaining pin is inserted into the affixing through hole. This provides a better, stronger connection between the two tank wall sections 110, 110'.

FIGS. 4A, 4B, 4C and 4D depict stages in urging the two adjacent tank wall sections into position and fastening them to each other with connectors. The tank walls 110, 110' to be joined are urged together with a tank wall clamp that includes a drawdown bracket 160 configured to fit over the elongated nub 148 and a bolt 162. The illustrated exemplary drawdown bracket 160 is a square box-shape sized to fit over the elongated nub 148, but other shapes can also be used. As seen in FIG. 4A, the tank wall ends are in proximity to each other, but are not aligned with each other and are not in touching relationship. As the tank wall sections 110, 110' are urged closer together, they are still off set from proper alignment and not in contact with each other. In FIG. 4B, the drawdown bracket 160 is used, along with bolt 162 engaged in a threaded hole in nose portion 152 of elongated nub 148, to commence pulling the tank wall sections into alignment, and closer together. The drawdown bracket 160 is used to pull the two tank wall sections together and into alignment such that the end brackets 144 and 142' are aligned and flush against each other, as shown in FIG. 4D.

As shown, the drawdown bracket 160 has a through hole and a bolt 162 passes through the hole and is threaded to a threaded hole in the flat top 154 of the nose 152 of the elongated nub 148. As the bolt 162 is screwed into the threaded hole in the top 154 of the elongated nub, the two end tank wall brackets 144 and 142' are urged toward each other and into alignment with each other by the pull force of the bolt on end bracket 144, the push force of the clamp 160 on the end bracket 142', and the guiding provided by the shape of elongated nose 152. The shape of the elongated nose 152 facilitates centering the elongated nose within the through hole 145' of tank wall end section 142'. Thus, the tank wall clamp, comprised of drawdown bracket 160 and bolt 162, urges the two end brackets 144 and 142' flush against each other and into alignment with each other, and in the process the other nubs 146 are also forced into alignment with, and are slotted within, through holes 145' of tank wall section 110'. This flush alignment of all nubs 146, 148 with all through holes 145' permits the affixing through holes 147 on the nubs 146, 148 to emerge on the outside of the ends of the flush end brackets to receive retaining pins 149, as shown in FIG. 5. Once the retaining pins 149 are inserted into the affixing through holes 147, the tank wall sections are effectively connected together and in an appropriate alignment relative to each other.

While at least one exemplary embodiment has been presented in the foregoing detailed description section, it should be appreciated that many variations exist. It should also be appreciated that the exemplary embodiments are only examples, and are not intended to limit the scope, applicability, or configuration of the claimed inventions in any way. Rather, the foregoing detailed description provides a convenient road map for those of ordinary skill in the art to implement exemplary embodiments. It should be understood that various changes can be made in the function and arrangement of elements described herein without departing from the scope of the patent claims listed below, including the legal equivalents of these patent claims.

The invention claimed is:

1. A tank wall section comprising:

a tank wall section body having upper and lower beams, a first outermost end strut at a first end of the tank wall section, and a second outermost end strut at an opposite end of the tank wall section;

a first end panel co-extensive with the tank wall section body and extending outwardly beyond the first end strut of the tank wall section body, the first end panel comprising spaced apart female connector components; and a second end panel co-extensive with the tank wall section body and extending outwardly beyond the second end strut of the tank wall section body, the second end panel comprising spaced apart male connector components, the male connector components extending radially out from an outer surface of the second end panel, each of the male connector components configured and spaced to register with a corresponding female connector component of a second tank wall section when the second end panel overlaps a first end panel of the second tank wall section, the male connector components each comprising through holes extending from a first side through an opposite side, the through holes configured to receive a retaining pin extending through the first side and the opposite side to thereby form a connector to couple the tank wall section to a second tank wall section, each connector comprising a male connector component extending through and protruding from an opposite side of a female connector component and held in place by a retaining pin;

wherein some of the male connector components have tapered, elongate nose portions extending radially out farther than outer extremities of other male connector components, tapered sides of the nose portions slidingly engaging female connector components to thereby guide each of the other male connector components into their corresponding female connector components, when the tank wall section is assembled to a second tank wall section.

2. The tank wall section of claim 1, wherein the male connector components comprise spaced apart nubs.

3. The tank wall section of claim 1, wherein the elongated nose portion has a substantially pyramidal or frusto-conical shape.

4. The tank wall section of claim 3, wherein the elongated nose portion comprises a threaded through hole to engage a threaded bolt, the bolt operatively connected to a drawdown bracket to align and to clamp tank wall sections together.

5. The tank wall section of claim 3, wherein the tank wall section body is stackable such that a plurality of tank wall sections stacked on top of each other form a stable stack.

6. The tank wall section of claim 1, wherein the tank wall section body further comprises an array of spaced support struts extending between the upper and the lower beams, and wall plate covering spaces between the support struts.

7. The tank wall section of claim 6, wherein the male connector component comprises nubs having a shape substantially in the form of a cube, rectangular box, cylinder, star, cone, pyramid, frusto-conical shapes or star-shapes.

8. A tank wall constructed from a series of tank wall sections joined end to end, the tank wall comprising:

a plurality of tank wall sections, each tank wall section comprising a tank wall section body, the tank wall section body comprising a lateral upper beam, a lateral lower beam, and support struts between the beams, each tank wall section body having:

a first end panel extending beyond a first end of the upper beam, co-extensively with the tank wall section, and comprising spaced apart female connector components; and a second end panel extending beyond a second end of the upper beam, co-extensively with the tank wall section, and overlapping a first end panel of an adjacent tank wall, the second end panel inboard from the first end panel, the second end panel comprising male connector components extending radially outward from an outer surface of the second end panel, the male connector components registering with, extending through, and protruding outward from, corresponding female connector components of the adjacent tank wall section, the male connector components each comprising affixing through holes extending from a first side of the male connector component through an opposite side of the male connector component, some of the male connector components having tapered, elongate nose portions extending radially out farther than outer extremities of other male connector components; and connectors coupling each of the plurality of tank wall sections to an adjacent tank wall section, the connectors each comprising a male connector component extending through and engaged with a female connector component, a retaining pin extending through an affixing through hole of a male connector component to retain the male connector component in position of extending through, and protruding outward from the female connector component.

9. The tank wall of claim 8, wherein each male connector component comprises a nub.

10. The tank wall of claim 9, wherein each female connector component comprises a through hole sized and configured to receive a nub.

11. The tank wall of claim 8, wherein the elongated nose portion has a substantially pyramidal or frusto-conical shape.

12. The tank wall of claim 11, wherein the elongated nose portion comprises a threaded through hole to engage a threaded bolt.

13. The tank wall of claim 8, wherein the male connector component comprises nubs having a shape substantially in the form of a cube, rectangular box, cylinder, star, cone, pyramid, frusto-conical shapes or star-shapes.

14. The tank wall of claim 8, wherein the struts of each of the plurality of the tank wall section bodies comprises an array of spaced support struts; and further comprises wall plate covering spaces between the support struts.

15. The tank wall section of claim 14, wherein the first end panel section of the tank wall section body extends out beyond a nearest adjacent support strut of the array of spaced apart support struts.

16. A circular tank wall constructed from a series of identical curved tank wall sections joined end to end, the tank wall comprising:

a plurality of curved tank wall sections, each tank wall section comprising a tank wall section body, the tank wall section body comprising a lateral upper beam, a lateral lower beam, and support struts between the beams, each tank wall section body having:

a first end panel extending beyond a first end of the upper beam, co-extensively with the tank wall section, and overlapping a second end panel of an adjacent tank wall, the second end panel inboard from the first end panel spaced apart female connector components arrayed vertically along an edge of the first end panel;

a second end panel extending beyond a second end of the upper beam, co-extensively with the tank wall section, and overlapping a first end panel of an adjacent tank wall, the second end panel inboard from the first end panel; and spaced apart male connector components arrayed vertically along an edge of the second end panel, each male connector extending radially outward from an outer surface of the second end panel, the male connector components each comprising through holes extending from a first side of the male connector component through an opposite side of the male connector component, some of the male connector components having tapered, elongate nose portions extending radially out farther than outer extremities of other male connector components, the elongate nose portion each having an axial threaded hole receiving a tool during tank wall assembly, each male connector component extending through, and protruding outward from a corresponding female connector component; and connectors coupling each of the plurality of curved tank wall sections to an adjacent tank wall section, the connectors each comprising a male connector component of a tank wall section extending through and engaged with a female connector component of an adjacent tank wall section, a retaining pin extending through a through hole at an outer end of the male connector component to join the tank wall sections.

* * * * *